US008764467B2

(12) United States Patent
Lee

(10) Patent No.: US 8,764,467 B2
(45) Date of Patent: Jul. 1, 2014

(54) EXTERNAL CONNECTOR FOR SOLID INSULATED LOAD BREAK SWITCHGEAR

(75) Inventor: Jae Gul Lee, Gyeonggi-do (KR)

(73) Assignee: LSIS Co., Ltd., Anyang, Gyeonggi-Do (KR)

( * ) Notice: Subject to any disclaimer, the term of this patent is extended or adjusted under 35 U.S.C. 154(b) by 124 days.

(21) Appl. No.: 13/324,959

(22) Filed: Dec. 13, 2011

(65) Prior Publication Data

US 2012/0156934 A1 Jun. 21, 2012

(30) Foreign Application Priority Data

Dec. 17, 2010 (KR) ..... 10-2010-0130138

(51) Int. Cl.
*H01R 13/53* (2006.01)

(52) U.S. Cl.
USPC ..... 439/181; 439/185

(58) Field of Classification Search
USPC ..... 439/181–189, 625, 89; 200/50.27, 200/50.24
See application file for complete search history.

(56) References Cited

U.S. PATENT DOCUMENTS 3,376,541 A * 4/1968 Link ..... 439/181
3,471,669 A * 10/1969 Curtis ..... 200/302.1
3,692,921 A * 9/1972 Yonkers ..... 439/126
3,915,534 A * 10/1975 Yonkers ..... 439/95
4,124,790 A * 11/1978 Kumbera et al. ..... 200/302.1
4,154,993 A * 5/1979 Kumbera et al. ..... 200/50.24
4,353,611 A * 10/1982 Siebens et al. ..... 439/475
4,863,392 A * 9/1989 Borgstrom et al. ..... 439/185
5,427,538 A * 6/1995 Knapp et al. ..... 439/157
5,846,093 A * 12/1998 Muench et al. ..... 439/89
6,227,908 B1 * 5/2001 Aumeier et al. ..... 439/607.01
6,991,484 B2 * 1/2006 Luzzi ..... 439/181
7,077,672 B2 * 7/2006 Krause et al. ..... 439/181
7,170,004 B2 * 1/2007 Gramespacher et al. .... 174/73.1
7,278,889 B2 * 10/2007 Muench et al. ..... 439/729
7,413,455 B2 * 8/2008 Hughes et al. ..... 439/187
7,950,939 B2 * 5/2011 Hughes et al. ..... 439/181
8,038,457 B2 * 10/2011 Hughes et al. ..... 439/181
8,043,102 B2 * 10/2011 Lu et al. ..... 439/181

FOREIGN PATENT DOCUMENTS

CN 101388536 3/2009
KR 10-0789446 12/2007

OTHER PUBLICATIONS

The State Intellectual Property Office of the People's Republic of China Application Serial No. 201110427164.9, Office Action dated Jan. 15, 2014, 6 pages.

* cited by examiner

*Primary Examiner* — Briggitte R Hammond
(74) *Attorney, Agent, or Firm* — Lee, Hong, Degerman, Kang & Waimey

(57) ABSTRACT

Disclosed is an external connector for a solid insulated load break switchgear. A semi-conductive layer for uniformly distributing an inner field is formed in a body part of a connector to uniformly distribute an inner field. This may prevent partial lowering of an insulating performance of the connector to enhance the insulating performance of the connector. Furthermore, a semi-conductive layer for uniformly distributing an outer field is formed between the connector and a bushing coupled to an upper end of the connector, and between the connector and a plug coupled to a lower end of the connector. This may allow an electric field to be uniformly distributed to a part connected to a ground surface of an arc extinguishing part.

10 Claims, 6 Drawing Sheets

EXTERNAL CONNECTOR FOR SOLID INSULATED LOAD BREAK SWITCHGEAR

CROSS-REFERENCE TO RELATED APPLICATION

Pursuant to 35 U.S.C. 119(a), this application claims the benefit of earlier filing date and right of priority to Korean Patent Application No. 10-2010-130138, filed on Dec. 17, 2010, the contents of which are hereby incorporated by reference herein in its entirety.

BACKGROUND OF THE INVENTION

1. Field of the Invention

The present invention relates to an external connector for a solid insulated load break switchgear, and particularly, to an external connector for a solid insulated load break switchgear capable of enhancing an insulting performance, and capable of connecting switches for three phases to one another with using connectors of the same shape.

2. Background of the Invention

A load break switchgear is an electrical apparatus used to diverge, test and maintain an undergrounded distribution line of a high voltage, and serves as distribution equipment of a high voltage of several tens of kilo volts (kV)~several hundreds of kilo volts (kV). Generally, the load break switchgear includes a plurality of switches having movable contactors and fixed contactors according to phases of R, S and T of alternating currents, and a terminal part connected to the switches. Since the load break switchgear deals with a high voltage, each switchgear is mounted in a container where an insulating gas such as sulphur hexafluoride ($SF_6$) is contained in a sealed state, the insulating gas having excellent arc-extinguishing and electric insulating performances.

Recently, it is required to remotely control the gas insulated load break switchgear so that the gas insulated load break switchgear may be open and closed in an automatic manner, for safety, rapidness in opening and closing operations, and reductions of a man power and costs. As relevant communications and motor control techniques develop, launched is a gas insulated load break switchgear having a control box installed therein, the control box having a communication function for automatic opening and closing in a remote manner, and having a motor actuator control function.

The control box obtains an operation power from a bus part of the load break switchgear, i.e., a line connected to an underground distribution line or a switchgear side. Since the control box is operated with a preset low direct current (DC), it is provided with a potential transformer installed therein so as to transform a high alternating current (AC) to a preset low DC.

The sulphur hexafluoride ($SF_6$), one of gases regarded as a major cause of the global warming, is not used as an insulating gas for the switchgear. Rather, being developed is a solid insulated load break switchgear where the switchgear is electrically insulated by a solid insulating material.

FIGS. 1 and 2 are an exploded perspective view and an assembled sectional view, respectively showing an external connector for a solid insulated load breaker switchgear in accordance with the conventional art.

As shown, the conventional solid insulated load break switchgear (hereinafter, will be referred to as a switchgear) is disposed at an upper part of a receptor (not shown), and an external connector 1 for electrically connecting a plurality of switches (not shown) to each other is disposed at a lower part of the receptor.

To the switchgears for three phases, bushings 2 are electrically connected. Below the bushings 2, disposed are connectors 3 of the external connector 1.

The bushings 2 are disposed in a single line in a horizontal direction so that each receptor (not shown) may be provided with three bushings for three phases (e.g., receptor 1*a* is provided with R1, S1 and T1, receptor 1*b* is provided with R2, S2 and T2, receptor 1*c* is provided with R3, S3 and T3, and receptor 1*d* is provided with R4, S4 and T4).

The connectors 3 are disposed in a single line in a horizontal direction in correspondence to the bushings 2. And, the connectors 3 are formed of rubber having conductivity. A plurality of switches for three phases such as R, S and T are horizontally disposed, and bus parts 4 are integrally provided at each one side of the switches for implementation of three phases. The bus parts 4 for three phases are formed at right and left sides of the connectors 3 and at upper and lower sides of the connectors 3, so as not to overlap one another on a horizontal line.

In the conventional external connector 1, the bushing 2 having a bushing conductor 2*a* is coupled to an upper end of the connector 3, and a plug 5 for connecting the bushing conductor 2*a* to one end of a connection conductor 3*a* of the connector 3 is coupled to a lower end of the connector 3. A bus conductor 4*a* provided in the bus part 4 is connected to another end of the connection conductor 3*a*, thereby being electrically connected to the bushing conductor 2*a* by the connection conductor 3*a*.

Unexplained reference numeral 3*b* indicates a bus connection part, 6 indicates a spring washer for elastically supporting the bushing conductor and the connection conductor, and 7 indicates a plug cap for prevention of introductions of foreign materials.

In the external connector of the conventional art, once an R phase is assembled, an S phase is assembled such that a bus part is toward a front side. Then, a T phase is assembled such that a bus part is toward a lower side in an opposite manner to the R phase.

However, the conventional solid insulated load break switchgear may have the following problems. Firstly, since the bus part 4 is formed to be slanted to one side of the connector 3, an electric field distributed on a connection surface where the bus part 4 is located (hereinafter, will be referred to as a first connection surface) 8*a* is asymmetrical to an electric field distributed on an opposite connection surface to the bus part 4 (hereinafter, will be referred to as a second connection surface) 8*b*. This may partially lower an insulating performance, and may cause dielectric breakdowns.

SUMMARY OF THE INVENTION

Therefore, an aspect of the detailed description is to provide an external connector for a solid insulated load break switchgear capable of enhancing an insulating performance on a connection surface by uniformly distributing an electric field to a bus part and an opposite part, and capable of connecting switches of three phases to one another with using components having the same shape.

To achieve these and other advantages and in accordance with the purpose of this specification, as embodied and broadly described herein, there is provided an external connector for a solid insulated load break switchgear, comprising: a bus part having a bus conductor; a connector having a connection conductor at one side thereof so as to be connected to the bus connector; a bushing having a bushing conductor inserted into one end of the connector, connected to the connection conductor and electrically connected to the bus conductor; and a plug inserted into another end of the connector, and coupled to the bushing, wherein the connector has a body part to which the bushing and the plug are coupled at two sides, the body part has a bushing inserting part and a plug inserting part at two sides based on the connection conductor, and at least one of the bushing inserting part and the plug inserting part has a semi-conductive layer.

According to another aspect of the present invention, there is provided an external connector for a solid insulated load break switchgear, comprising: a bus part having a bus conductor; a connector having a connection conductor at one side thereof so as to be connected to the bus connector; a bushing having a bushing conductor inserted into one end of the connector, connected to the connection conductor and electrically connected to the bus conductor; and a plug inserted into another end of the connector, and coupled to the bushing, wherein the connector has a body part to which the bushing and the plug are coupled at two sides, the body part has a bushing inserting part and a plug inserting part at two sides based on the connection conductor, and the body part is formed of an insulating material.

According to still another aspect of the present invention, there is provided an external connector for a solid insulated load break switchgear, comprising: a bus part having a bus conductor; a connector having a connection conductor at one side thereof so as to be connected to the bus connector; a bushing having a bushing conductor inserted into one end of the connector, connected to the connection conductor and electrically connected to the bus conductor; and a plug inserted into another end of the connector, and coupled to the bushing, wherein the connector has a body part to which the bushing and the plug are coupled at two sides, the body part has a bushing inserting part and a plug inserting part at two sides based on the connection conductor, a bus connection part connected to the bus part is by encompassing the connection conductor is formed in a bending manner at one side of an outer circumferential surface of the body part, and the bus connection part is formed on an outer circumferential surface of the connection conductor in the same thickness.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail of the exemplary embodiments, with reference to the accompanying drawings. For the sake of brief description with reference to the drawings, the same or equivalent components will be provided with the same reference numbers, and description thereof will not be repeated.

Hereinafter, an external connector for a solid insulated load break switchgear according to the present invention will be explained in more details with reference to the attached drawings.

Figure 5:
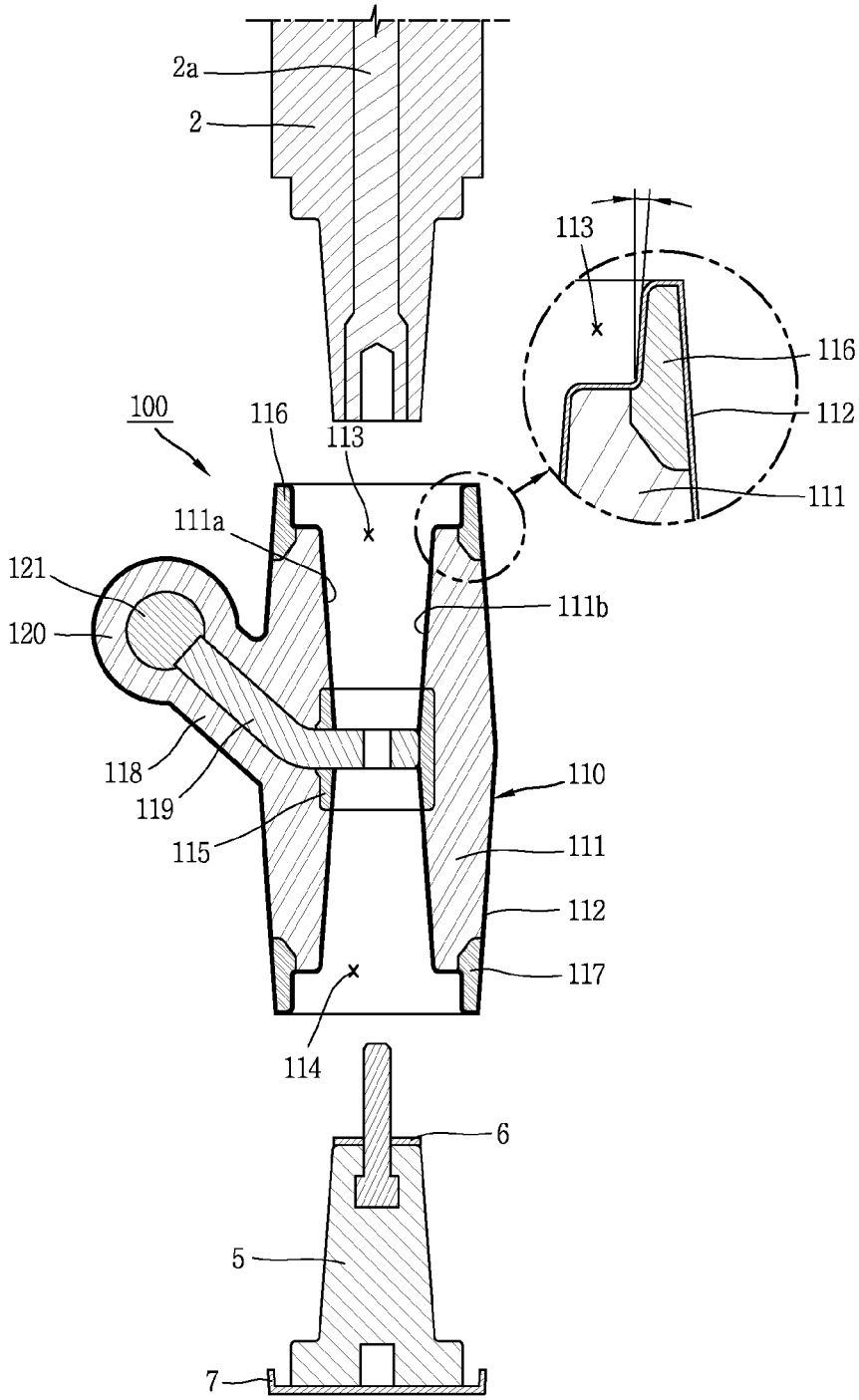
FIG. 5 is a sectional view showing a bushing and a plug of an external connector are separated from each other according to the present invention.
Figure 6:
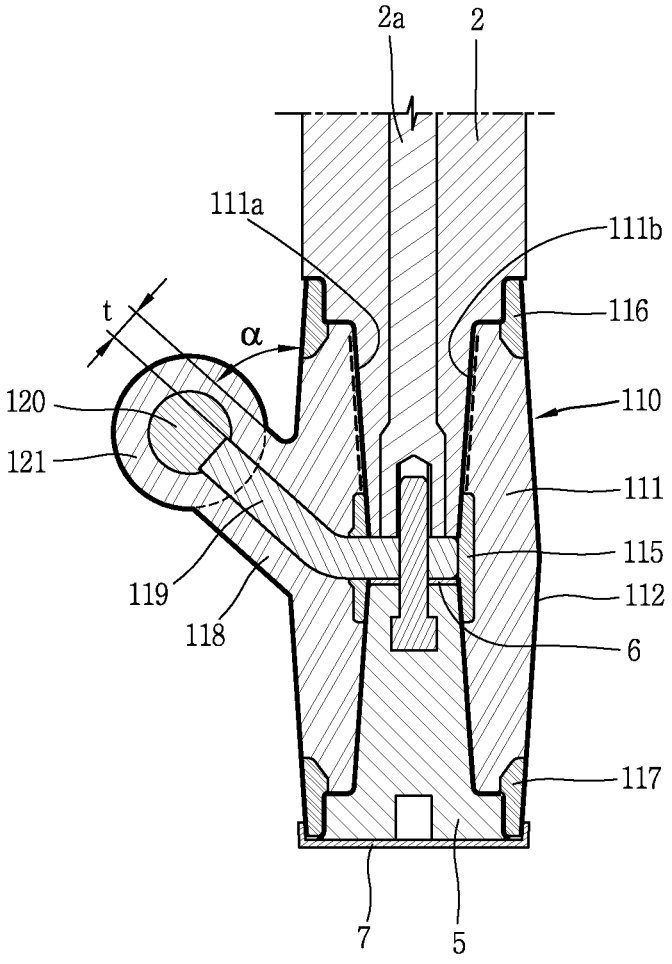
FIG. 6 is a sectional view showing a bushing and a plug of an external connector are assembled to each other according to the present invention.

FIG. 5 is a sectional view showing a bushing and a plug of an external connector are separated from each other according to the present invention, and FIG. 6 is a sectional view showing a bushing and a plug of an external connector are assembled to each other according to the present invention.

As shown, a solid insulated load break switchgear having an external connector 100 (hereinafter, will be referred to as a switchgear for each phase) according to the present invention is disposed at an upper part of each receptor (not shown). And, the external connector 100 for electrically connecting switches for phases to one another is disposed at a lower part of each receptor.

Bushings 2 are electrically connected to the switches for phases, and connectors 110 of the external connector 100 are disposed below the bushings 2 thus to be coupled to the bushings 2.

The bushings 2 are provided in three in number for three phases in each receptor. For instance, receptor 1*a* is provided with R1, S1 and T1, receptor 1*b* is provided with R2, S2 and T2, receptor 1*c* is provided with R3, S3 and T3, and receptor 1*d* is provided with R4, S4 and T4. A plurality of bushings 2 for phases are disposed in a single line in a horizontal direction. A bushing conductor 2*a* electrically connected to a bus conductor 121 of a bus part 120 coupled to the connector 110 is provided in the bushing 2 in a lengthwise direction.

The connectors 110 are disposed in a single line in a horizontal direction in correspondence to the bushings 2, respectively.

The connector 110 is formed of an insulating material such as silicone or ethylene propylene rubber (EPDM rubber), and is provided with a body part 111 which constitutes an inner insulating layer of the connector 110.

The body part 111 is formed in a cylindrical shape long in upper and lower directions. On an outer circumferential surface of the body part 111, disposed is an outer surface part 112 formed of a conductive silicone pigment or a carbon black-based semiconductor and constituting an outer insulating layer.

A bushing inserting part 113 for inserting the bushing 2 is formed at an upper end of the body part 111, and a plug inserting part 114 for inserting the plug 5 is formed at a lower end of the body part 111. The bushing inserting part 113 is formed such that a sectional area thereof is downward narrowed, and the plug inserting part 114 is formed such that a sectional area thereof is upward narrowed so as to be symmetrical to the bushing inserting part 113.

At an intermediate part of an inner circumferential surface of the body part 111, i.e., between an inner circumferential surface of the end of the bushing inserting part 113 and an inner circumferential surface of the end of the plug inserting part 114, formed is a semi-conductive layer for uniformly distributing an inner field (hereinafter, will be referred to an inner semi-conductive layer) 115 for uniformly-distributing an inner field by encompassing part of the bushing and the plug. Between an upper end of the connector 110 and the bushing 2, i.e., between an inner circumferential surface of a starting end of the bushing inserting part 113 of the connector 110 and an outer circumferential surface of an exposed part of the bushing 2, formed is a semi-conductive layer for uniformly distributing an outer field (hereinafter, will be referred to a first outer semi-conductive layer) 116 for uniformly-distributing an outer field between the connector 110 and the bushing 2 by encompassing part of the connector 110 and the bushing 2. Between a lower end of the connector 110 and the plug 5, i.e., between an outer circumferential surface of a starting end of the plug inserting part 114 of the connector 110 and an outer circumferential surface of an exposed part of the plug 5, formed is a semi-conductive layer for uniformly distributing an outer field (hereinafter, will be referred to a second outer semi-conductive layer) 117 for uniformly-distributing an outer field between the connector 110 and the plug 5 by encompassing part of the connector 110 and the plug 5.

The inner semi-conductive layer 115 is formed in a cylindrical shape having a height high enough to encompass part of opposing ends of the bushing 2 and the plug 5. And, each of the first outer semi-conductive layer 116 and the second outer semi-conductive layer 117 is formed in a cylindrical shape having a height high enough to encompass part of an upper end of the connector 110 and an entire part of an exposure end of the bushing 2, or part of a lower end of the connector 110 and an entire part of an exposed part of the plug 5. In order to stably support the bushing 2 and the plug 5, the inner semi-conductive layer 115 is preferably formed to have a diameter decreased toward an intermediate part from two ends thereof, i.e., toward a connection conductor.

Preferably, the inner semi-conductive layer 115, the first outer semi-conductive layer 116, and the second outer semi-conductive layer 117 are formed of the same material. The inner semi-conductive layer 115, the first outer semi-conductive layer 116 and the second outer semi-conductive layer 117 are firstly put into a metallic pattern, and then an insulating material melting liquid of the body part 111 is put to form the body part 111, the inner semi-conductive layer 115, the first outer semi-conductive layer 116, and the second outer semi-conductive layer 117 integrally with one another, the inner semi-conductive layer 115, the first outer semi-conductive layer 116 and the second outer semi-conductive layer 117 are preferably formed of a material having a melting point higher than that of the body part 111. The inner semi-conductive layer 115, the first outer semi-conductive layer 116, and the second outer semi-conductive layer 117 may be formed of differential materials.

For enhanced coupling between the bushing 2 and the plug 5, each of the first outer semi-conductive layer 116 and the second outer semi-conductive layer 117 is formed in a cylindrical shape such that a sectional surface of an inner circumferential surface thereof is inward narrowed a little.

A bus connection part 118 connected to the bus part 120 is formed at one side of the body part 111, and a connection conductor 119 for electrically connecting the bushing conductor 2*a* to the bus conductor 121 is provided in the bus connection part 118 in a lengthwise direction.

The bus connection part 118 is formed to have a bending angle (α) so as to be bent toward the center to the maximum within the range that the connection conductor 119 does not influence on an insulating performance of the body part 111. And, the bus connection part 118 is formed to encompass an outer circumferential surface of the connection conductor 119 in the same thickness (t).

The bus parts 120 for phases are provided right and left, and up and down based on the body part 111 so as not to overlap one another on a horizontal line. A bus conductor 121 electrically connected to the bushing conductor 2*a* by the connection conductor 119 is provided in the bus part 120 in a lengthwise direction.

Between the plug 5 and the connector 110, interposed is a spring washer 6 for enhancing a coupling force between the connection conductor 119 and the bushing conductor 2*a* by elastically supporting the connection conductor 119. A plug cap 7 formed of a conductive material and configured to prevent introductions of foreign materials is coupled to a lower end of the plug 5.

The same parts as the conventional parts are provided with the same reference numerals.

In the external connector of the present invention, once an R phase is assembled, an S phase is assembled such that a bus part is toward a front side. Then, a T phase is assembled such that a bus part is toward a lower side in an opposite manner to the R phase.

The bushing inserting part 113 and the plug inserting part 114 of the connector 110 are formed to be symmetrical to each other. This may allow the switchgears of three phases to be connected to one another without an additional cable. Since the bus part 120 is formed not to overlap the bushing 3, the same components may be assembled to switches of three phases without any interference. This may shorten an assembly time.

However, the bus part 120 is formed to be slanted to one side of the connector 110. This may cause an electric field strength not to be uniformly formed between a second insulating surface 111*b* of the body part 111 having no bus connection part 118, and a first insulating surface 111*a* having the bus connection part 118. As a result, an insulating performance may be significantly lowered.

In the present invention, an electric field strength may be uniformly implemented because the body part 111 is formed of an insulating material such as silicone or EPDM rubber such that the body part 111 serves as an inner insulating layer, and because an outer insulating layer 112 formed of a conductive silicon pigment or a carbon black-based semi-conductor is disposed on an outer circumferential surface of the body part 111.

Furthermore, a semi-conductive layer for uniformly distributing an inner field which constitutes the inner semi-conductive layer 115 is formed between the bushing inserting part 113 and the plug inserting part 114. And, a semi-conductive layer for uniformly distributing an outer field which constitutes the first outer semi-conductive layer 116 and the second outer semi-conductive layer 117 is formed between an upper end of the connector 110 and the bushing 2, and between a lower end of the connector 110 and the plug 5, respectively. Through these two semi-conductive layers for uniformly-distributing an electric field of the body part 111, the connector may have optimized electric field distributions.

The bus connection part 118 connected to the bus part 120 positioned on a side surface of the connector 110 is formed to have a bending angle so as to be bent toward the center to the maximum within the range that an insulating performance of the insulating layer is not influenced. And, the bus connection part 118 is formed to have the same thickness (t). This may allow an electric field to be uniformly distributed to the first insulating surface 111*a* having the bus part 120.

Figure 7:
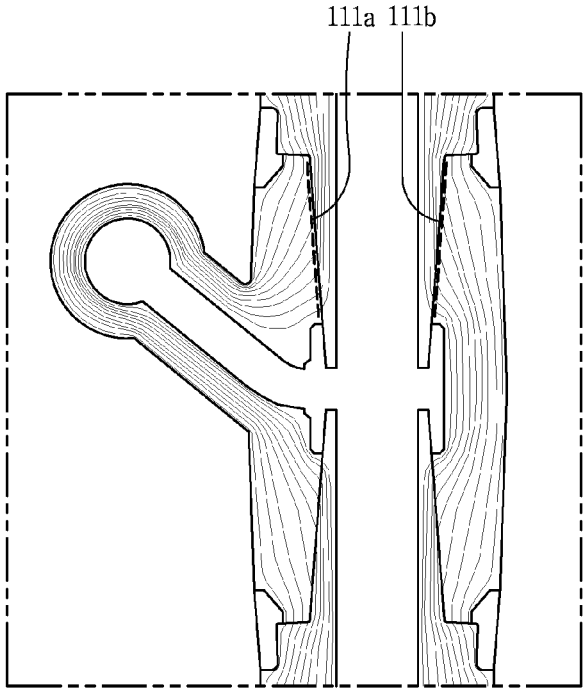
FIGS. 7 and 8 are graphs showing electric field distributions on a connector and an insulating surface, respectively according to the present invention.

FIG. 7 is a mimetic diagram showing distributions of equipotential lines with respect to a first insulating surface 16 and a second insulating surface 15 according to the present invention.

Figure 1:
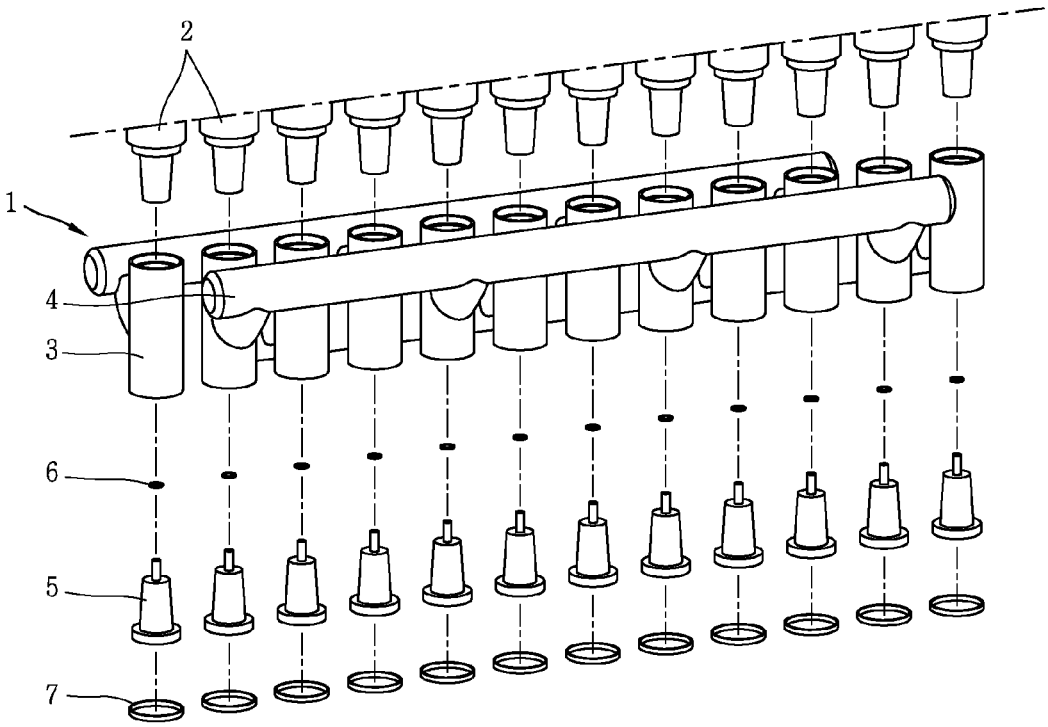
FIG. 1 CONVENTIONAL ART
FIGS. 1 and 2 are an exploded perspective view and an assembled sectional view, respectively showing an external connector for a solid insulated load breaker switchgear in accordance with the conventional art.
Figure 2:
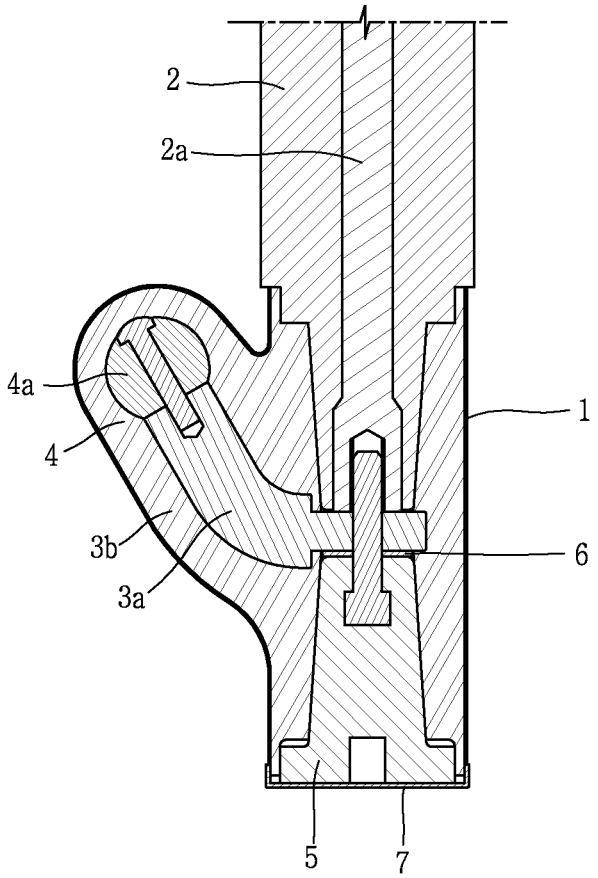
FIG. 2 CONVENTIONAL ART
Figure 3:
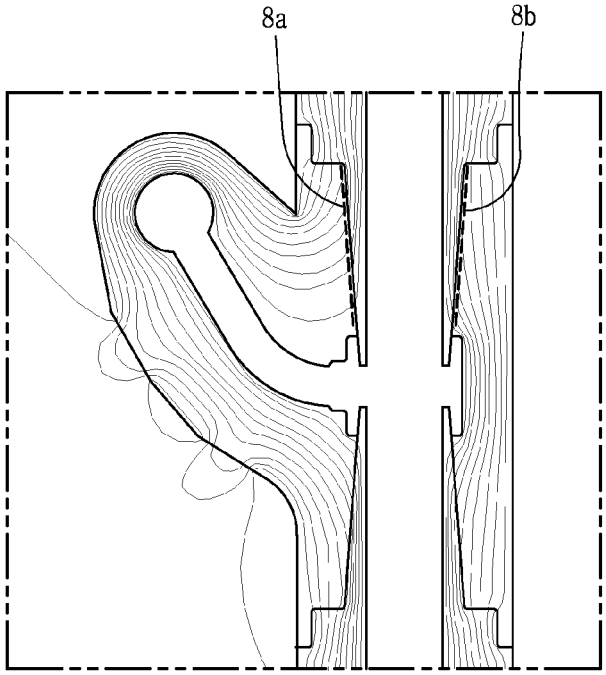
FIG. 3 CONVENTIONAL ART
FIGS. 3 and 4 are graphs showing electric field distributions on a connector and an insulating surface, respectively in accordance with the conventional art.
Figure 4:
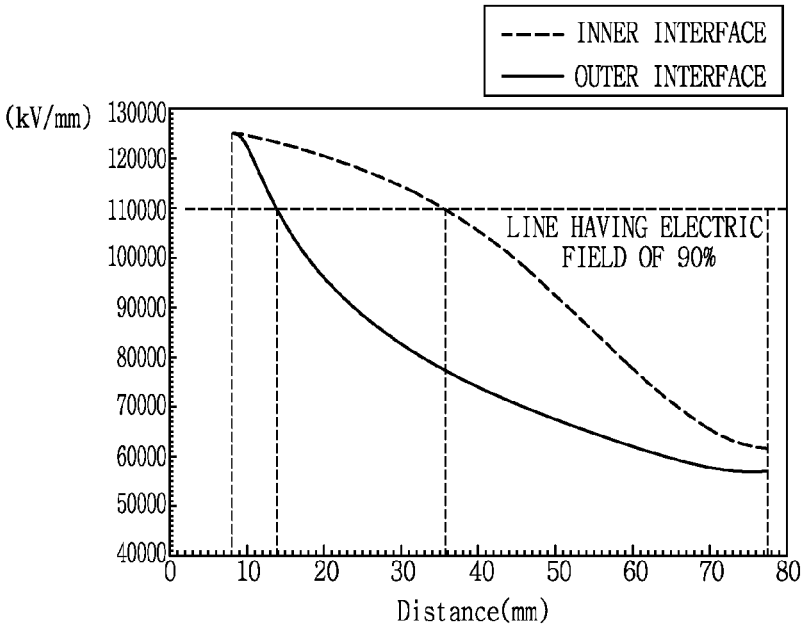
FIG. 4 CONVENTIONAL ART

Referring to FIG. 7, an electric field is more uniformly distributed than the conventional electric field distributed on an insulating surface of FIG. 2.

Figure 8:
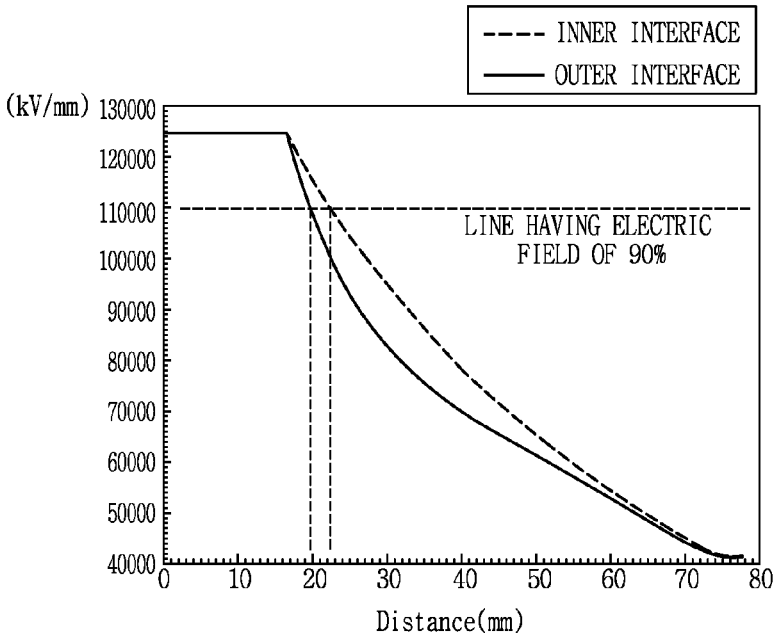

FIG. 8 is a graph showing electric field distributions on a first insulating surface and a second insulating surface according to the present invention. Referring to FIG. 8, since a gap between an inner interface and an outer interface is narrowed at the periphery of the first and second insulating surfaces, an electric field is uniformly distributed.

Since the semi-conductive layer for uniformly distributing an inner field is formed in the body part, an inner field is uniformly distributed. This may prevent partial lowering of an insulating performance of the connector, and thus enhance the insulating performance of the connector. Furthermore, since the semi-conductive layer for uniformly distributing an outer field is formed between the connector and the bushing, and between the connector and the plug, an electric field is uniformly distributed to a part connected to a ground surface of an arc extinguishing part.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. An external connector for a solid insulated load break switchgear, comprising:

a bus element comprising a bus conductor;

a connector comprising a connection conductor at a first side of the connector, the connection conductor connected to the bus conductor;

a bushing comprising a bushing conductor and inserted into a first end of the connector and connected to the connection conductor such that the bushing conductor is electrically connected to the bus conductor; and a plug inserted into a second end of the connector and coupled to the bushing, wherein the connector comprises a connector body to which the bushing and the plug are coupled, the connector body comprising:

a first opening defining a first cavity to receive the bushing and a second opening defining a second cavity to receive the plug, wherein the first cavity and second cavity are opposite each other relative to the connection conductor;

a first outer semi-conductive layer provided at a circumference of the first opening;

a second outer semi-conductive layer provided at a circumference of the second opening; and an inner semi-conductive layer provided at a circumference of an inner end of the first cavity and a circumference of an inner end of the second cavity.

2. The external connector of claim 1, wherein the inner semi-conductive layer comprises a cylindrical shape, and the connection conductor protrudes through a first side of the inner semi-conductive layer.

3. The external connector of claim 1, wherein a diameter of the circumference of the inner end of the first cavity is smaller than a diameter of the first opening, and a diameter the circumference of the inner end of the second cavity is smaller than a diameter of the second opening.

4. The external connector of claim 1, wherein the inner semi-conductive layer is formed of a material having a melting point higher than that of a material forming the connector body.

5. The external connector of claim 1, wherein the first outer semi-conductive layer has a diameter larger than a diameter of the inner end of the first cavity and the second outer semi-conductive layer has a diameter larger than a diameter of the inner end of the second opening.

6. The external connector of claim 1, wherein the first outer semi-conductive layer and the second outer semi-conductive layer are formed of a material having a melting point higher than that of a material forming the connector body.

7. The external connector of claim 1 wherein the inner semi-conductive layer and the first and second outer semi-conductive layers are formed of the same material.

8. The external connector of claim 1, wherein the connector further comprises a bus connection body connected to the bus element and enclosing the connection conductor;

wherein:

the bus connection body protrudes from the first side of the connector at a non-perpendicular angle relative to the length of the connector, and a thickness of the bus connection body is consistent along the entire length of the bus connection body.

9. The external connector of claim 1, wherein the connector body is formed of an insulating material.

10. The external connector of claim 9, wherein an insulating layer formed of a different material than a material forming the connector is provided on an outer surface of the connector.

* * * * *